US010533791B2

(12) United States Patent
Gatter et al.

(10) Patent No.: US 10,533,791 B2
(45) Date of Patent: Jan. 14, 2020

(54) DOMESTIC REFRIGERATION APPLIANCE WITH A DRAWER ARRANGED IN A MOUNTED POSITION WITH PLAY ON A PULLOUT CARRIAGE

(71) Applicant: BSH HAUSGERAETE GMBH, Munich (DE)

(72) Inventors: Andreas Gatter, Giengen (DE); Herbert Cizik, Ottenbach (DE); Stefan Deissler, Noerdlingen (DE)

(73) Assignee: BSH Hausgeraete, Munich (DE)

( * ) Notice: Subject to any disclaimer, the term of this patent is extended or adjusted under 35 U.S.C. 154(b) by 65 days.

(21) Appl. No.: 15/728,944

(22) Filed: Oct. 10, 2017

(65) Prior Publication Data

US 2018/0100689 A1 Apr. 12, 2018

(30) Foreign Application Priority Data

Oct. 12, 2016 (DE) ..... 10 2016 219 876

(51) Int. Cl.

| | |
|---|---|
| ***A47B 96/04*** | (2006.01) |
| ***F25D 25/02*** | (2006.01) |
| ***A47B 88/477*** | (2017.01) |
| ***A47B 88/483*** | (2017.01) |

(Continued)

(52) U.S. Cl.

CPC ..... *F25D 25/025* (2013.01); *A47B 88/477* (2017.01); *A47B 88/483* (2017.01); *F25D 23/067* (2013.01); *F25D 25/005* (2013.01); *A47B 2210/175* (2013.01)

(58) Field of Classification Search

CPC ..... A47B 2210/17; A47B 2210/175; A47B 88/477; A47B 88/483; F25D 25/025

See application file for complete search history.

(56) References Cited

U.S. PATENT DOCUMENTS

| | | | | |
|---|---|---|---|---|
| 9,677,806 | B2 | 6/2017 | Bischofberger et al. | |
| 10,161,672 | B2 * | 12/2018 | Cizik | A47B 88/477 |

(Continued)

FOREIGN PATENT DOCUMENTS

| | | | |
|---|---|---|---|
| DE | 4040341 | C2 | 5/1994 |
| DE | 102007051343 | A1 | 4/2009 |

(Continued)

*Primary Examiner* — Matthew W Ing

(74) *Attorney, Agent, or Firm* — Laurence A. Greenberg; Werner H. Stemer; Ralph E. Locher

(57) ABSTRACT

A domestic refrigeration appliance has a receptacle chamber for food being delimited by walls of an inner container. A pull-out device is arranged on the inner container and can be pushed into and withdrawn from the receptacle chamber relative to the inner container. A container for receiving food is provided. The container is removably positionable on the pull-out device. The container has at its rear region a coupling element which engages in a coupling pocket provided on the pull-out device, so that a tilt prevention device is provided for the container. A mounted position of the container in which the container is placed on the pull-out device, is configured with a relative movement capability in relation to the pull-out device, having play defined as seen in the depth direction. The tilt prevention device is configured such that over the entire play, the coupling element extends into the coupling pocket.

21 Claims, 15 Drawing Sheets

(51) Int. Cl.
*F25D 23/06* (2006.01)
*F25D 25/00* (2006.01)

(56) References Cited

U.S. PATENT DOCUMENTS

| | | | | |
|---|---|---|---|---|
| 2012/0306338 | A1* | 12/2012 | Nagahata | F25D 23/067 312/405.1 |
| 2013/0264928 | A1* | 10/2013 | Hong | F25D 25/025 312/404 |
| 2015/0316314 | A1* | 11/2015 | Bassler | F25D 25/025 312/408 |
| 2016/0216027 | A1* | 7/2016 | Go | F25D 25/024 |
| 2018/0038632 | A1* | 2/2018 | Yang | F25D 25/025 |
| 2018/0100686 | A1* | 4/2018 | Cizik | F25D 23/067 |

FOREIGN PATENT DOCUMENTS

| | | | |
|---|---|---|---|
| DE | 102014203066 | A1 | 8/2015 |
| EP | 2564729 | A1 | 3/2013 |
| EP | 3043132 | A1 | 7/2016 |
| WO | 2009053312 | A2 | 4/2009 |
| WO | 2011026749 | A2 | 3/2011 |
| WO | 201304042338 | A2 | 3/2013 |
| WO | 2015082282 | A1 | 6/2015 |
| WO | 2015124433 | A1 | 8/2015 |
| WO | 2016129944 | A1 | 8/2016 |

* cited by examiner

DOMESTIC REFRIGERATION APPLIANCE WITH A DRAWER ARRANGED IN A MOUNTED POSITION WITH PLAY ON A PULLOUT CARRIAGE

CROSS-REFERENCE TO RELATED APPLICATION

This application claims the benefit, under 35 U.S.C. § 119, of German patent application DE 10 2016 219 876.9, filed Oct. 12, 2016; the prior application is herewith incorporated by reference in its entirety.

BACKGROUND OF THE INVENTION

Field of the Invention

The invention relates to a domestic refrigeration appliance with a receptacle chamber for food which is delimited by walls of an inner container. The domestic refrigeration appliance further contains a pull-out device which is arranged on the inner container and is able to be pushed into and withdrawn from the receptacle chamber relative to the inner container. Furthermore, the domestic refrigeration appliance contains at least one container which is configured for receiving food and which is removably positionable on the pull-out device which is separate for this purpose. The container has, at a rear region, a coupling element which engages in a coupling pocket provided on the pull-out device, so that by use of the coupling element and the coupling pocket, a tilt prevention device for the container is provided.

A configuration of this type is known, for example, from published, European patent application EP 2 564 729 A1. Therein, the pull-out device is formed only by opposing telescopic extenders arranged on vertical side walls of the inner container. A drawer placeable on these telescopic extenders engages with a rear tongue in the coupling element which has an indentation. In a front region of the drawer, a hole is formed on a web protruding laterally from a vertical side wall of the drawer, through which hole an engaging pin which is arranged on the running rail of the telescopic extender engages when the drawer is placed on the telescopic extenders. The engaging pin and the rear coupling element are both formed on the running rail of a telescopic extender and, in the installed state, the drawer is positionally fixed on the running rail and is therefore arranged thereon with an exact fit. In a configuration of this type, the removal of the drawer from the running rail is more difficult due to the exactly fitting mounting and is associated with a corresponding force application. The same applies for the placement of the drawer on the telescopic extenders. Apart from the placement and removal being made more difficult, damage to the coupling elements and increased wear can thereby also occur.

Containers are known in a great variety of versions. They can be simple drawers which are open and in which the same ambient humidity always prevails as in the remaining receptacle chamber. Furthermore, keep-fresh containers for food in domestic refrigeration appliances are known in which an ambient humidity different from that of the receptacle chamber or a different humidity level is settable and this can take place independently of the remainder of the receptacle chamber. For this purpose, the domestic refrigeration appliance typically contains a humidifying device with which a fluid mist can be generated that can be introduced directly into the storage region or the keep-fresh container. The humidifying device contains, as known, a tank with water from which the fluid mist is generated with an atomizer unit, for example a piezoelement, and is then conducted by a blower directly via a conduit connection and independently of the receptacle chamber into the keep-fresh container. The keep-fresh container is displaceably arranged in a housing of the domestic refrigeration appliance. Such embodiments are known from the prior art.

Furthermore, international patent disclosure WO 2011/026749 A2 (corresponding to U.S. Pat. No. 9,677,806) discloses a corresponding refrigeration appliance with a vegetable compartment. A drawer for receiving the vegetables can be introduced into and removed from the interior. The drawer is coverable from above with a cover. In the closed state, the cover lies on angled upper edges of the drawer. A further panel is arranged above the cover on which a front strip is provided, on which an operating element is movably positioned. The operating element can be displaced parallel to the front strip and, for this purpose, is coupled to an inclined guideway in the form of a slit which is formed in the cover. Dependent upon this displacement of the pusher, a lifting of the cover takes place which is coupled by a corresponding mechanical coupling to the plate arranged thereabove.

Furthermore, from German patent DE 40 40 341 C2, a keep-fresh box with a closable cover is known. The box is also insertable into an interior of a domestic refrigeration appliance.

In both embodiments known from the prior art, it is intended to protect the refrigeration goods introduced thereinto, for example, in the form of vegetables, salad, meat, fruit and the like against undesirably rapid dehydration. The problems arising in this regard have previously been adequately described in DE 40 40 341 C2.

SUMMARY OF THE INVENTION

It is an object of the present invention to provide a domestic refrigeration appliance in which a positioning of a container on a pull-out device is improved.

An inventive domestic refrigeration appliance contains a receptacle chamber for food which is delimited by walls of an inner container. The domestic refrigeration appliance further contains a pull-out device which is arranged on the inner container and is able to be pushed into and withdrawn from the receptacle chamber relative to the inner container. This occurs in the depth direction of the domestic refrigeration appliance. Furthermore, the domestic refrigeration appliance contains a container which is configured separately from the pull-out device and is configured for receiving food. The food-receiving container is removably positionable on the pull-out device so that it is arranged there in a non-destructively releasable manner. Thus, the container can be reversibly removed from the pull-out device and replaced again. The container has at its rear region a coupling element which engages in a coupling pocket provided on the pull-out device, if the container is arranged on the pull-out device. By use of the coupling element and the coupling pocket, a tilt prevention device for the container is provided so that the container, in its mounted position placed on the pull-out device, cannot tilt about an axis oriented in the width direction of the domestic refrigeration appliance. Undesirable tilting of the container is thereby prevented.

A substantial concept of the invention lies therein that a mounted position of the container in which the container is placed on the pull-out device is configured with a relative movement capability in relation to the pull-out device, having play defined as seen in the depth direction of the domestic refrigeration appliance. This means that, in this mounted position, which is also pre-determined, the container is not positionally fixed and thus also is not arranged with exact fit on the pull-out device, but even in this mounted position, there exists a still possible relative movement between the drawer and the pull-out device. The tilt prevention device is configured such that over the entire range of this relative movement capability, the coupling element extends into the coupling pocket. This therefore means that tilting of the container beyond this overall movement play in the mounted position is prevented. By means of such an embodiment, therefore, a simpler removal and replacement of the container from or into the pull-out device is achieved and nevertheless an undesirable tilting is prevented in all withdrawal positions of the pull-out device.

In particular, it is provided that a pull-out stop element is provided on the pull-out device, by which the container is limited forwardly in its relative movement capability in relation to the pull-out device. By use of the pull-out stop element, the play in the depth direction is limited forwardly. Thereby, an undesirable further forward movement of the container relative to the pull-out device is prevented. An undesirable uncoupling of the tilt prevention device is thereby prevented.

Preferably, the play is less than 1.5 cm, in particular between 0.5 cm and 1.5 cm.

In particular, it is provided that a stop is provided on the container, the stop being configured, on a movement of the container relative to the pull-out device, seen in the depth direction of the domestic refrigeration appliance, for contacting the pull-out stop element. A very simple embodiment for secure and robust prevention of a movement of the container undesirably far forward relative to the pull-out device is thereby achieved.

It is preferably provided that the stop is configured as a skid on an underside of the container. Thereby, an increased intrinsic mechanical stability of the stop is achieved and also a greater connecting area with the container or its underside. Thereby also, correspondingly greater forces which can occur with a corresponding impact can be absorbed. In particular, this skid extends in the depth direction of the domestic refrigeration appliance. It extends from the underside of the container downwardly, as seen in the height direction. It can be provided that this stop configured as a skid extends over at least half, preferably at least two thirds of the extent of the underside of the container, as seen in the depth direction. Preferably, the stop ends with its front end offset rearwardly, as seen in the depth direction, relative to a front end of the underside of the container or a floor of the container. Preferably, the front end of the stop is offset rearwardly by at least a fifth of the extent of the underside in the depth direction of the domestic refrigeration appliance relative to the front end of this underside.

In a further advantageous embodiment, it is provided that the coupling element is configured integrated into this stop and is therefore configured in one piece with the stop. Thereby, an intrinsically very stable component can be provided and it is also possible that the coupling element is formed from a very exposed site, specifically in particular, protruding rearwardly in the depth direction from a rear end of the stop, so that a particularly advantageous and secure coupling into the coupling pocket is enabled. Furthermore, with a configuration of this type, the coupling element can also be configured relatively small, for example, as coupling pin which can then also engage tongue-like into the coupling pocket. Advantageously, a space-minimizing solution is thereby created. Furthermore, with this embodiment of the integrated arrangement of the coupling element into the stop, an aligned positioning between the extent of the stop in the depth direction and the coupling element then extending further rearwardly in the depth direction is achieved.

In particular, it is provided that, as seen in the height direction of the domestic refrigeration appliance, in the mounted position of the container on the pull-out device, the stop is arranged with a lower edge spaced from, and therefore arranged contactlessly relative to, this pull-out device. Thereby, a very low-friction embodiment is achieved since the stop slides along with its lower edge not on the pull-out device.

This is particularly advantageous if the container is placed at other sites on other components of the pull-out device and can correspondingly slide along there. For example, the container can then be placed slidingly directly on a support panel. In addition and/or instead thereof, it can also be provided that the container is contacted with guide elements at vertical side walls which it has and is seated thereon, wherein the guide elements can be, for example, components of holding brackets or holding elements which in turn, for example, are connected to a door of the pull-out device, in particular arranged on an inner side of said door of the pull-out device.

In an alternative embodiment, however, it can also be provided that this stop is seated contactingly with the lower edge on the pull-out device, which is possible precisely if no support panel is provided on which the container can be directly contactingly placed.

It is preferably provided that the pull-out device has a slotted guide which is configured at least upwardly open wherein, in the mounted position of the container on the pull-out device, a stop provided on the container engages from above in the slotted guide and is guided. With this embodiment, a very simple and targeted placement and removal of the container onto or from the pull-out device is achieved and nevertheless a secure guidance is then also enabled in the mounted position by the play configured as defined in the depth direction. Furthermore, by the slotted guide, an undesirable displacement of the container relative to the pull-out device as seen in the width direction of the domestic refrigeration appliance is also prevented.

In particular, the slotted guide is configured open not only upwardly, but also to a vertical wall of the inner container. The above-mentioned advantages are thereby further improved.

In particular, the slotted guide contains a web or a slotted guide wall extending in the depth direction. The stop on the container is arranged, as seen in the width direction of the domestic refrigeration appliance, further outwardly and thus further toward the vertical side wall of the inner container than the slotted guide wall.

It is provided, in particular, that the coupling pocket is integrated into this slotted guide and, in particular, is configured as a rear end of the slotted guide and is integrated accordingly. Thereby, the coupling pocket is advantageously multifunctional and components are therefore spared. The slotted guide wall opens, in particular, into the walls delimiting the coupling pocket.

In a further advantageous embodiment, it is provided that the pull-out stop element is integrated into the slotted guide, in particular, as a front end of the slotted guide. Thereby also, a component minimization is achieved and additionally the slotted guide is configured intrinsically more mechanically stable. The slotted guide wall opens, in particular, into the stop.

Through the positional arrangement of the coupling pocket and of the pull-out coupling element with regard to the integration into the slotted guide, the configuration of the play defined in the depth direction is also precisely predetermined and simultaneously, the slotted guide is defined in its dimensions and its functionality.

In particular, it is provided that the pull-out device has at least one support rail on which the coupling pocket is provided. The support rail is, in particular, an elongate component, preferably made of plastics, which is configured in one piece. On the upper side of this rail, the coupling pocket is configured integrated protruding upwardly raised. In particular, configured in this support rail is a slotted guide for guiding the container with the integrated coupling pocket. Hereby also, the component count can be reduced and the mounting effort and the mounting tolerances can be avoided and a simple and economical component can be produced, in particular as an injection molded component.

It is preferably provided that the pull-out device has two such separate support rails on each of which on opposite sides, corresponding coupling pockets are formed, in particular with corresponding slotted guides, so that coupling elements provided respectively on opposite sides of the container can engage in the coupling pockets.

In a particularly advantageous embodiment, it is provided that the pull-out device also has, in additional these support rails, a support panel which is arranged between the support rails and is connected to the rails. These support rails also form edge protection sleeves or impact protection elements for the support panel, which can also be made of glass. Thereby, a base element or base panel is provided, having a large area but also being thin in the height direction, on which the at least one container is securely placeable. Precisely by means of this multipart base panel, the support panel can be made of a separate material, in particular glass and nevertheless, the at least one coupling pocket, the at least one slotted guide and the at least one pull-out stop element can be integrated mechanically stably and simply into a component of the base panel separate therefrom, specifically a support rail.

In this regard, the pull-out device contains, in particular, a previously mentioned support panel on which the container is placed in its mounted position. In particular, in such an embodiment, the container has at least one positioning skid on its underside which, in the mounted position of the container, is seated directly on the pull-out device on an upper side of this support panel and makes contact with this upper side. The positioning skid is preferably formed integrally on the underside and extends in the depth direction. Preferably, two such positioning skids are provided.

In an advantageous embodiment, it is provided that the container in its mounted position on the pull-out device, seen in the depth direction of the domestic refrigeration appliance, is arranged protruding forwardly in relation to the support rail and/or in relation to the support panel. This is a very advantageous embodiment, since a desired air circulation can thus take place in the receptacle chamber which then is not interrupted or hindered by the support rail and the support panel in this front region of the container. This air stream can thus also flow unhindered directly to this front region of the container and can there flow past so that a desired circulation of the air stream in the receptacle chamber is also achieved and it is not slowed or interrupted, precisely at this transition site between the support rail and/or the support panel, on one side, and the container, on the other. A particularly advantageous cooling in the receptacle chamber and thus also in the container is thereby achieved.

It is also particularly advantageous if in addition to the support panel and the support rails, the pull-out device contains separate holders and/or holding elements which are, in particular, panel-shaped angled components and extend rail-like in the depth direction of the pull-out device. In particular, these holding elements are each formed in one piece from metal. They are, in particular, suspension elements with which the support panel and the support rails are suspended on at least one pull-out rail of the pull-out device.

A pull-out rail is, in particular, a telescopic extender which contains a fixed rail and at least one movable running rail connected thereto and movable relative thereto. The fixed rail is fastened, in particular, on an inner side of a vertical side wall of the inner container. The pull-out rail is a component separate from the holding element.

By means of the support panel, the support rails and the holding elements which are connected to the base panel at opposite sides of the base panel in the width direction, in particular to the support rails, a mounting cage for at least one container is formed from these components. The mounting cage is laterally delimited by the holding elements which also form side walls of the mounting cage with their panel shape. In the depth direction rearwardly, the mounting cage is configured open. The mounting cage is hung or suspended with the holding elements on the aforementioned pull-out rails which are separate from the mounting cage.

In particular, the pull-out device has a mounting cage for the container, containing a base panel and, seen in the width direction of the domestic refrigeration appliance, arranged thereon at opposite sides and separate from the base panel, holding elements as lateral cage walls, wherein the holding elements are configured as suspending elements for non-destructively releasable suspension of the mounting cage on pull-out rails of the pull-out device separate from the mounting cage. Thereby, a stable receiving of one or more containers is possible, so that a positionally secure arrangement of the container is enabled both in the unloaded as well as the loaded state. In the unloaded state in which the container has a low weight, it is securely positioned even on sudden displacement of the pull-out device. In the loaded state, due to the mounting cage, a highly loadable construction is achieved which can also bear the weight while an easy-moving displacement of the pull-out device is achieved. Due to the individual design of the mounting cage, however, comprehensive accessibility of the container is nevertheless always achieved, even in the pulled-out state, so that the handling of the container is simple and user-friendly.

The mounting cage can also be designated, or be, a mounting channel or a mounting seat.

The base panel can be, in particular, a tray.

Seen in the depth direction of the domestic refrigeration appliance, in particular, the mounting cage it is configured rearwardly open. Thereby, the access to the container is further improved and the weight of the mounting cage is reduced.

In particular, the base panel is non-destructively releasably connected to the holding elements. Through this disassembly capability, the base panel can be easily cleaned in its individual parts.

In particular, the base panel is connected to the holding elements by means of interlocking plug-in connections. These connections are mechanically stable and enable a particularly easy disassembly and reassembly.

In particular, the holding elements each have a support web on which the base panel is seated. Thereby, a mechanically stable positioning of the base panel is achieved but nevertheless the installation space is not undesirably restricted.

Preferably, at least one support web contains at least one receptacle into which a coupling element which is configured, in particular, on an underside of the base panel, is inserted for connecting to the holding element. Preferably, the receptacle is a through hole, having in particular a polygonal hole contour. In particular, the coupling element is configured for insertion into the receptacle with an exact fit.

In particular, the base panel is configured as multi-part and contains a support panel and support rails which are connected to the support panel, as seen in the width direction of the domestic refrigeration appliance, at opposite sides of the support panel. Thereby, the base panel can meet the different requirements at different sites and can thus, firstly, enable a stable connection to other components of the pull-out device and, secondly, enable a secure receiving of the container. Thereby, the stability of the pull-out device is high, particularly in the region in which the container is placed. Furthermore, the modularity is great and the handling is simple for disassembly and reassembly. Thus, individual parts of the base panel and the pull-out device can be made simple and cleaned individually. Due to the smaller parts, these can also be placed in a dishwasher.

In particular, the pull-out device contains a base panel for placement of the container which is configured multipart and contains a support panel and, arranged on opposite sides, as seen in the width direction of the domestic refrigeration appliance, support rails arranged thereon. At least one support rail has at least one integrated coupling element for non-destructively releasable coupling of the base panel to at least one further component of the pull-out device.

In particular, the pull-out device contains, as further components, holding elements which are configured as suspending elements for non-destructively releasable suspension of the base panel at separate pull-out rails of the pull-out device, and the base panel is connected to the holding elements by interlocking plug-in connections.

In an advantageous embodiment, it is provided that the pull-out device is configured as a pull-out carriage which contains a door on which on an inner side of the door facing toward the receptacle chamber, rearwardly protruding rail-like angle brackets or holders are arranged which are, in particular, the aforementioned holding elements of the mounting cage. Mounted on these holders, in particular indirectly mounted, is the container. This means that in addition to the holders, further separate components are provided, in particular, the support rails and/or the support panel with which the container is then directly coupled and, via these support rails and/or the support panel, it is indirectly coupled to the holders. Preferably, therefore, the domestic refrigeration appliance also contains a tray or a type of compartment floor which contains the aforementioned support rails and the support panel. The door of the pull-out carriage is a front wall which, in the closed state of the pull-out carriage, represents a front outer part of the domestic refrigeration appliance.

In a further advantageous embodiment, it is provided that, between the inner side of the door and a front end of the support rails facing toward the inner side of the door and/or the support panel, a gap is formed. The aforementioned advantages with regard to the unhindered throughflow of the air stream are thereby favored, including with this specific configuration with a pull-out carriage.

In particular, it is provided that the container has at least at one vertical side wall, a step so that an upper wall portion of the vertical side wall, as seen in the height direction of the domestic refrigeration appliance, is offset outwardly, as seen in the width direction of the domestic refrigeration appliance, relative to a lower wall portion of this vertical side wall. Thereby, a support plateau is created on the vertical side wall with which the container can be placed from above on a bearing part and/or a guide element. For example, the guide element can be the aforementioned rail-like holder and/or the holding element of the mounting cage.

The door in the embodiment of the pull-out device as a pull-out carriage is a front-side closing part which, in the closed state of the pull-out carriage, represents an outer part of the domestic refrigeration appliance. By the door, in the closed state of the pull-out carriage and therefore the completely pushed-in state of the pull-out carriage, the receptacle chamber is closed at the front side.

The container is preferably configured as a drawer so that it is a trough-like component and only accessible from above. It can also be configured as a keep-fresh container. For this purpose it has, in particular, a drawer and a cover with which the drawer is closable. The cover is liftable and lowerable by an actuating mechanism, such that, dependent upon the position of the cover, moisture can escape from the keep-fresh container or is trapped therein. With the addition of fluid mist by an aforementioned humidifying device, a humidity level in the keep-fresh container can be set independently of the residual volume of the receptacle chamber.

The stipulations "above", "below", "in front", "behind", "horizontal", "vertical", "depth direction", "width direction", "height direction", etc., indicate positions and orientations during proper use and arrangement of the appliance and with an observer positioned in front of, and looking in the direction of, the appliance.

Further features and embodiments of the invention are disclosed in the claims, the drawings and the description of the drawings. The features and combinations of features mentioned in the description above and the following features and combinations of features in the description of the drawings and/or shown in the drawings alone are usable not only in the respective combination given, but also in other combinations without departing from the scope of the invention. Embodiments of the invention which are not explicitly shown in the figures and described, but which arise and can be created through separate combinations of features from the embodiments described are therefore also to be considered as included and disclosed. Embodiments and combinations of features can also be regarded as disclosed which therefore do not have all the features of an originally formulated independent claim. Furthermore, embodiments and combinations of features are to be regarded as disclosed, in particular by the embodiments disclosed above, which go beyond or deviate from the combinations of features represented by the references in the claims.

Other features which are considered as characteristic for the invention are set forth in the appended claims.

Although the invention is illustrated and described herein as embodied in a domestic refrigeration appliance with a drawer arranged in a mounted position with play on a pull-out carriage, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
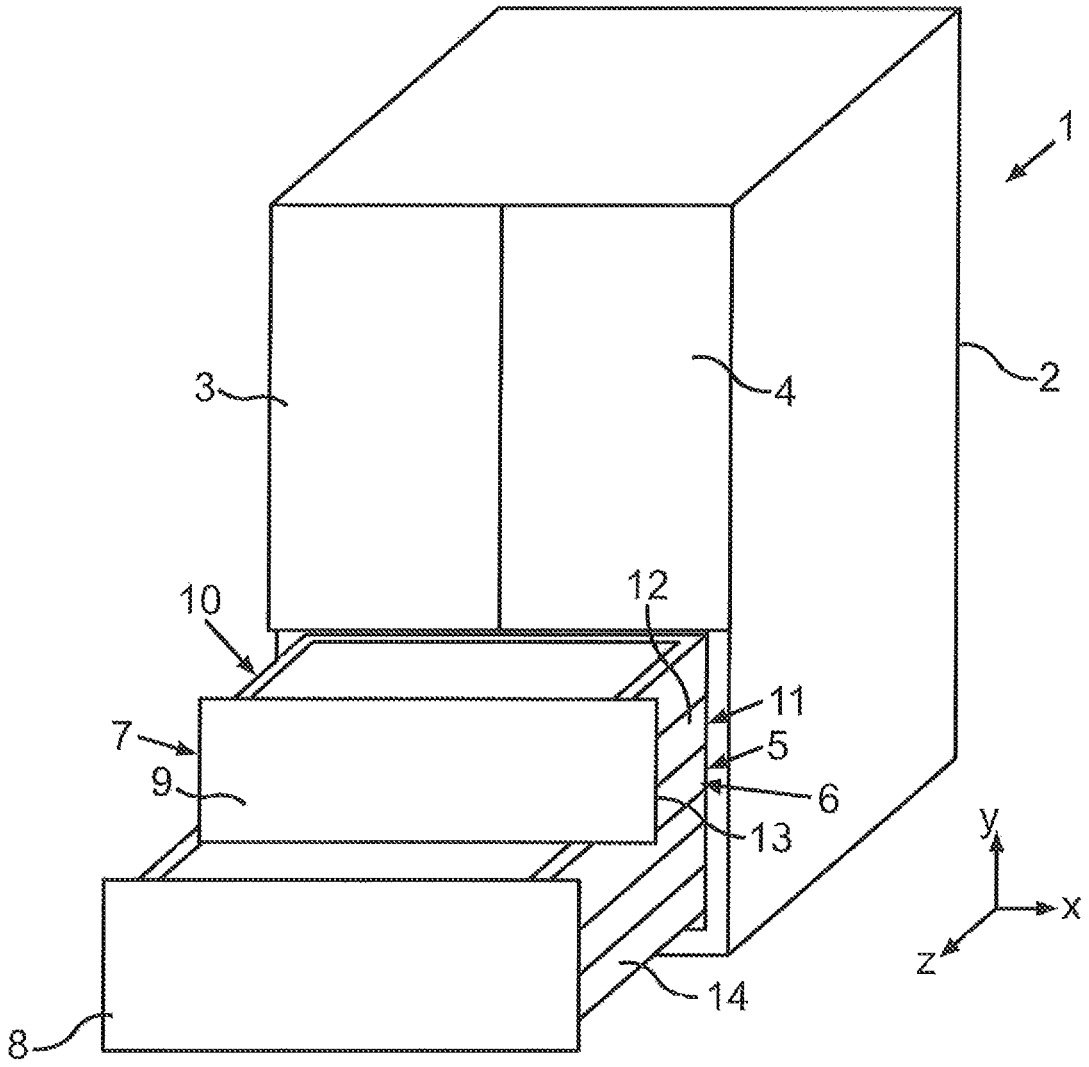
FIG. 1 is a perspective view of an exemplary embodiment of an inventive domestic refrigeration appliance.

In the drawings, the same or functionally identical elements are provided with the same reference characters.

FIG. 1 shows a simplified representation of a domestic refrigeration appliance 1 which is configured for storing and conserving food. The domestic refrigeration appliance 1 in the exemplary embodiment is a refrigerator-freezer combination device but can also be a stand-alone refrigerator device or freezer device.

The domestic refrigeration appliance 1 has a housing 2 in which an inner container is provided which delimits with walls a first receptacle chamber for food, which is closable at the front side by at least one door, in the exemplary embodiment, two separate doors 3 and 4. The doors 3 and 4 are pivotably arranged on the housing 2 and can be pivoted outwardly independently of one another. The pivoting is herein enabled about a vertical axis and thus about an axis in the height direction (y-direction).

The receptacle chamber closable by the preferably two doors 3 and 4 is, in the exemplary embodiment, a refrigerator compartment.

Furthermore, the domestic refrigeration appliance 1 has a further inner container 5 which, with its walls, delimits a further second receptacle chamber 6 which is separate from the first receptacle chamber and here is a freezing compartment. In the exemplary embodiment, it is provided that in the second receptacle chamber 6, a first pull-out carriage 7 can be pushed in and pulled out in the depth direction and thus in the z-direction of the domestic refrigeration appliance 1. In particular, it is provided in the exemplary embodiment that the domestic refrigeration appliance 1 has a second pull-out carriage 8 which, in corresponding manner, can be pushed into the receptacle chamber 6 and pulled out therefrom.

The following description will be made referring to the first pull-out carriage 7. The descriptions can advantageously also apply to the second pull-out carriage 8. The pull-out carriages 7 and 8 are pull-out devices of the domestic refrigeration appliance 1.

The first pull-out carriage 7 contains a door 9 which represents a front wall and also a front closing part and thus also an outer part of the domestic refrigeration appliance 1. The first pull-out carriage 8 further has a food-receiving container which herein is a drawer 10 which is thus configured as a trough-like container and is arranged for loading with food or for removal of food from above. The pull-out carriage 7 preferably further has, on opposite sides, pull-out rails 11 which are each arranged with a fixed rail on an inner side of vertical side walls of the inner container 5 and also each have at least one running rail. The pull-out rails 11 are therefore, in particular, telescopic extenders. The pull-out rails 11 are arranged on opposite sides of the drawer 10. In particular, it is provided in the exemplary embodiment that the first pull-out carriage 7 has rail-like holders or holding elements 12 wherein in FIG. 1 only the rail-like holding element 12 at the right, on viewing from the front side, is visible which is fastened to an inner side 13 of the door 9 facing toward the second receptacle chamber 6. These rail-like holding elements 12 are angle brackets that are preferably connected to the running rails. They are configured as plate-like and partially angled components made of metal. They are each hooked from above onto a running rail of a pull-out rail 11.

Figure 2:
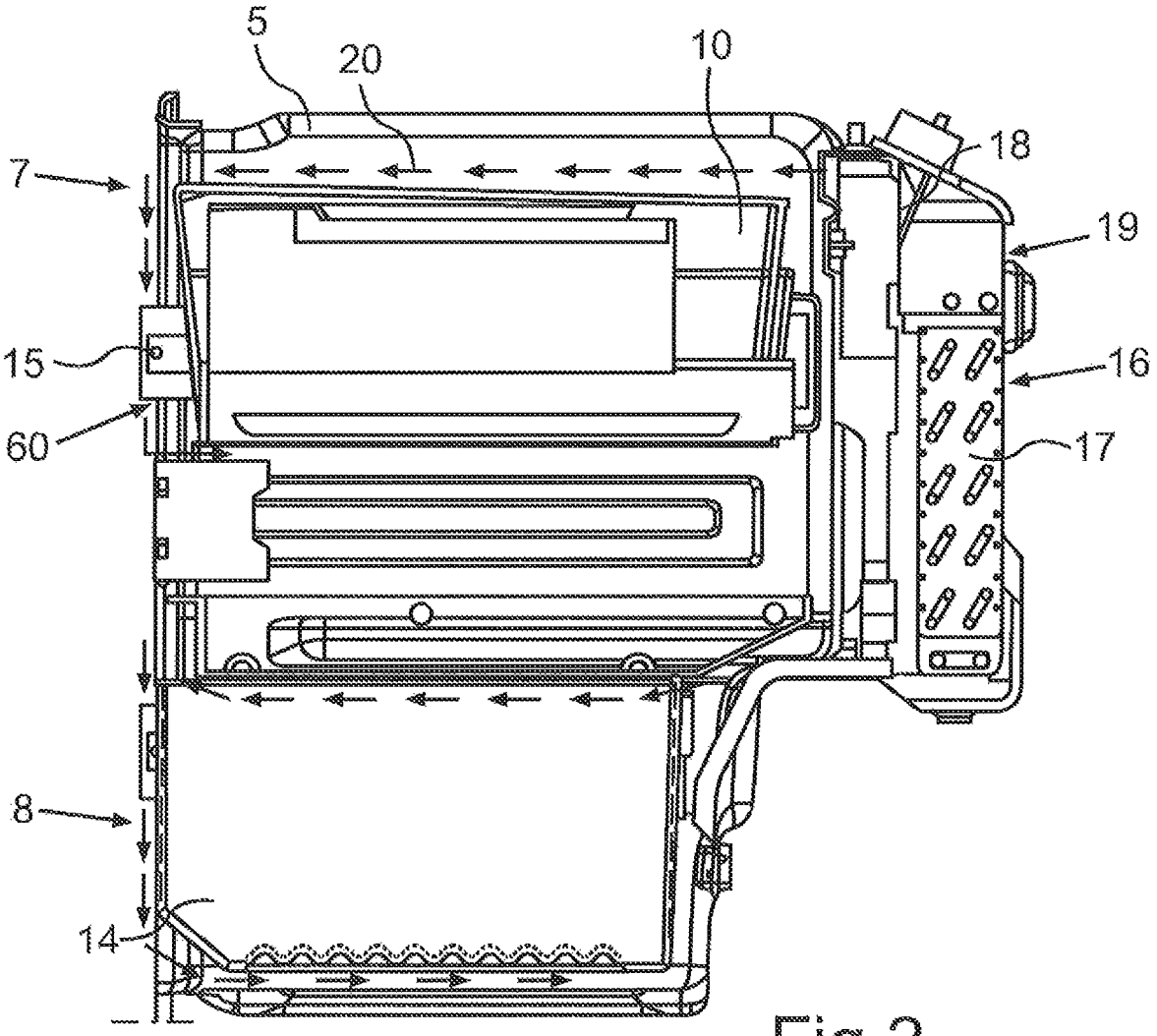
FIG. 2 is a simplified sectional view of the domestic refrigeration appliance of FIG. 1 in a region of a freezing compartment.

FIG. 2 shows a simplified sectional view of the region of the domestic refrigeration appliance 1 which represents the receptacle chamber 6 with the pull-out carriages 7 and 8. It is apparent that the door 9 and also the door of the second pull-out carriage 8 are not shown. A further container for food as a second drawer 14 which is associated with the second pull-out carriage 8 is also shown in FIG. 2. Both the pull-out carriages 7 and 8 are shown in the fully pushed-in state. The representation of FIG. 2 is a view in the negative x-direction and thus in the width direction of the domestic refrigeration appliance 1 so that in FIG. 2, the further rail-like holding element 15 positioned opposite the rail-like holding element 12 is visible.

It is further apparent that in the exemplary embodiment it is provided that in the freezing compartment or the second receptacle chamber 6, an introduction of cooling energy takes place by a module 16 which has, in particular, an evaporator 17 and a blower 18 and which is preferably arranged in its own housing 19. By means of this unit which represents a cooling device, by an evaporator 17, cooling energy is generated which is then circulated as an air stream 20 in the receptacle chamber 6 by the blower 18.

Figure 3:
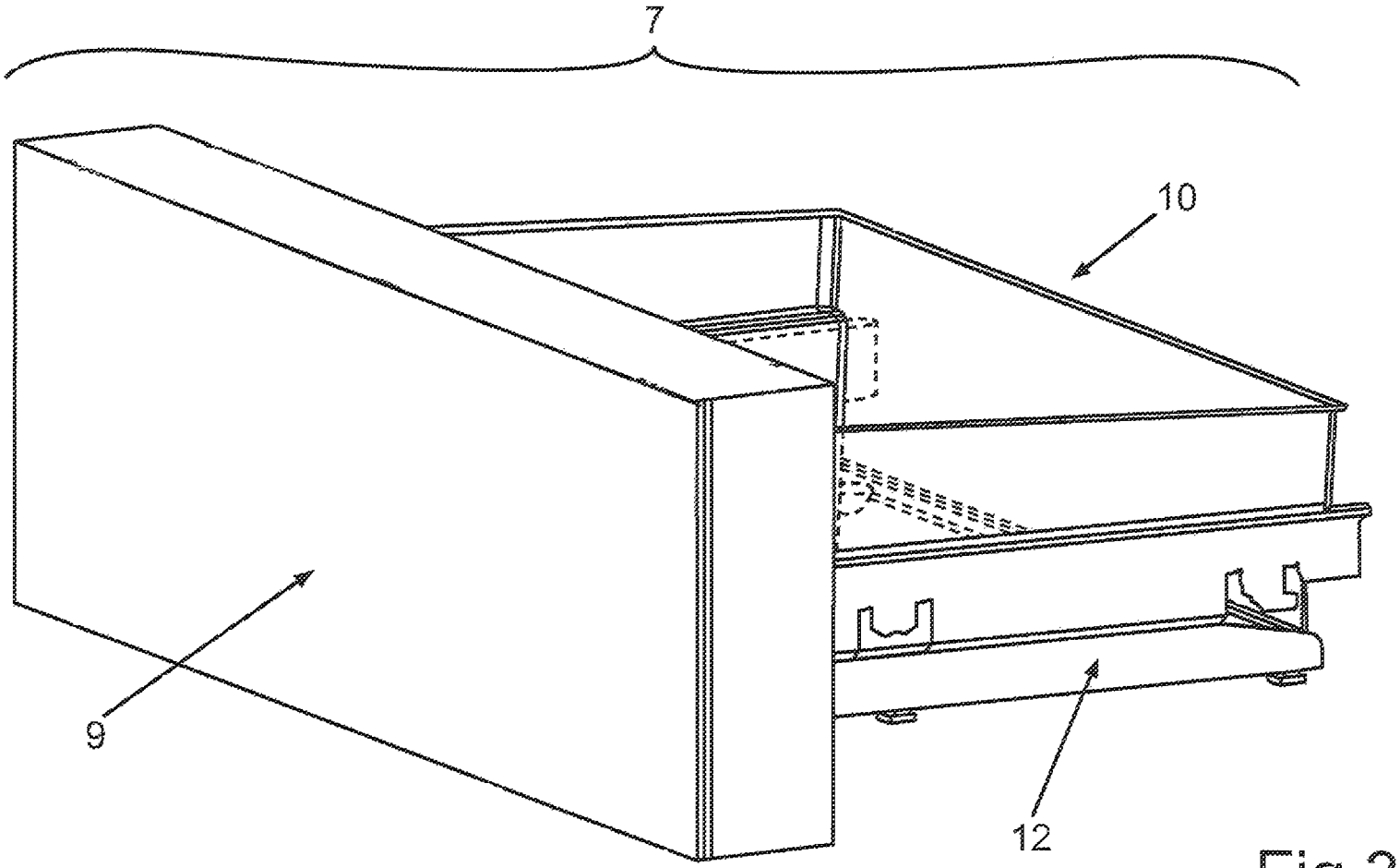
FIG. 3 is a perspective view of a pull-out device with a container of the domestic refrigeration appliance according to FIG. 1 and FIG. 2.

FIG. 3 shows a perspective view of the pull-out carriage 7 with the drawer 10 placed in the mounted position. On viewing from the front, the drawer 10 is completely covered by the door 9.

Figure 4:
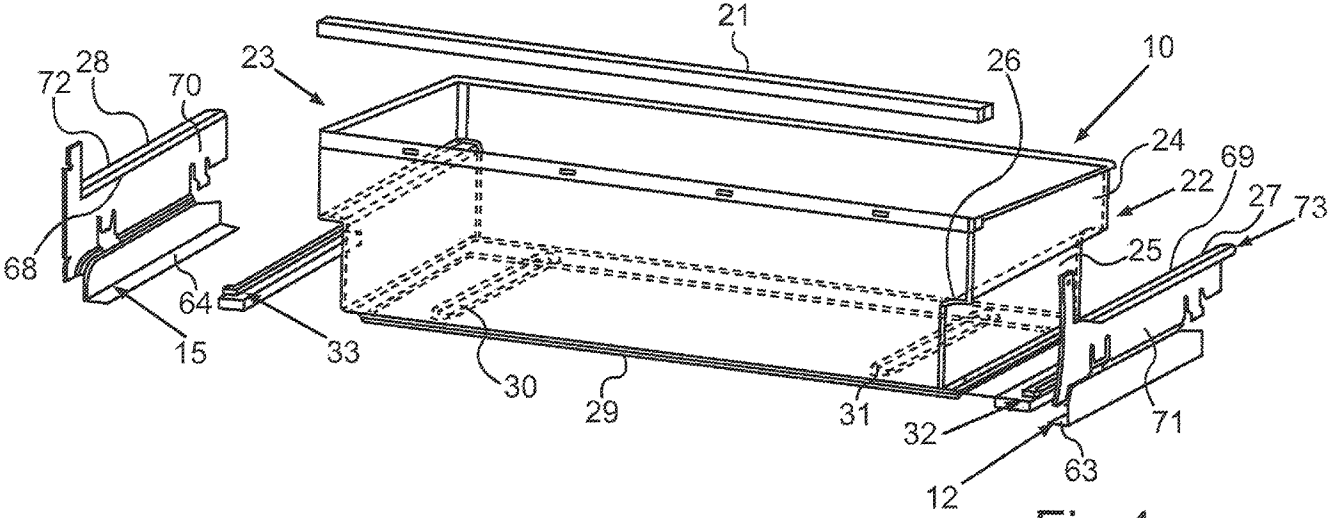
FIG. 4 is an exploded, perspective view of components of the view in FIG. 3.

FIG. 4 shows subcomponents of the representation in FIG. 3 in an exploded view. The drawer 10 is configured as a single-piece plastics container on which, for example, a front strip 21 can be arranged.

As shown, herein the drawer 10 has two mutually opposed vertical side walls 22 and 23. The side wall 22 contains an upper wall portion 24 and, seen in the height direction, a lower wall portion 25. The two wall portions 24 and 25 are configured, seen in the width direction of the domestic refrigeration appliance 1, offset from one another, wherein for this a discrete step 26 is provided at approximately half the height of the side wall 22. The upper wall portion 24 is thus, seen in the width direction, offset further outwardly than the lower wall portion 25. The opposite side wall 23 is configured accordingly.

In the mounted state, the drawer 10 is seated, in an advantageous embodiment, on guide elements 27 and 28 of the holding elements 12, 15, wherein herein the placement of the drawer 10 on these guide elements 27 and 28 takes place precisely on these steps. The guide elements 27 and 28 are outwardly bent webs or wings. The guide elements 27 and 28 are oriented standing outwardly from upper edges 68 and 69 of respective panel-shaped basic parts 70 and 71 of the holding elements 12 and 15.

It is also recognizable that webs and/or positioning skids 30 and 31 are integrally formed onto a floor or an underside 29 of the drawer 10 and extend downwardly from this underside 29.

Furthermore, in FIG. 4, support rails 32 and 33 belonging to the pull-out device and thus to the pull-out carriage 7 are shown which are preferably one-piece plastics components. The support rails 32 and 33 are components separate from the holding elements 12 and 15. The holding elements 12 and 15 are preferably made of metal and are also, in particular, configured in one piece.

Figure 5:
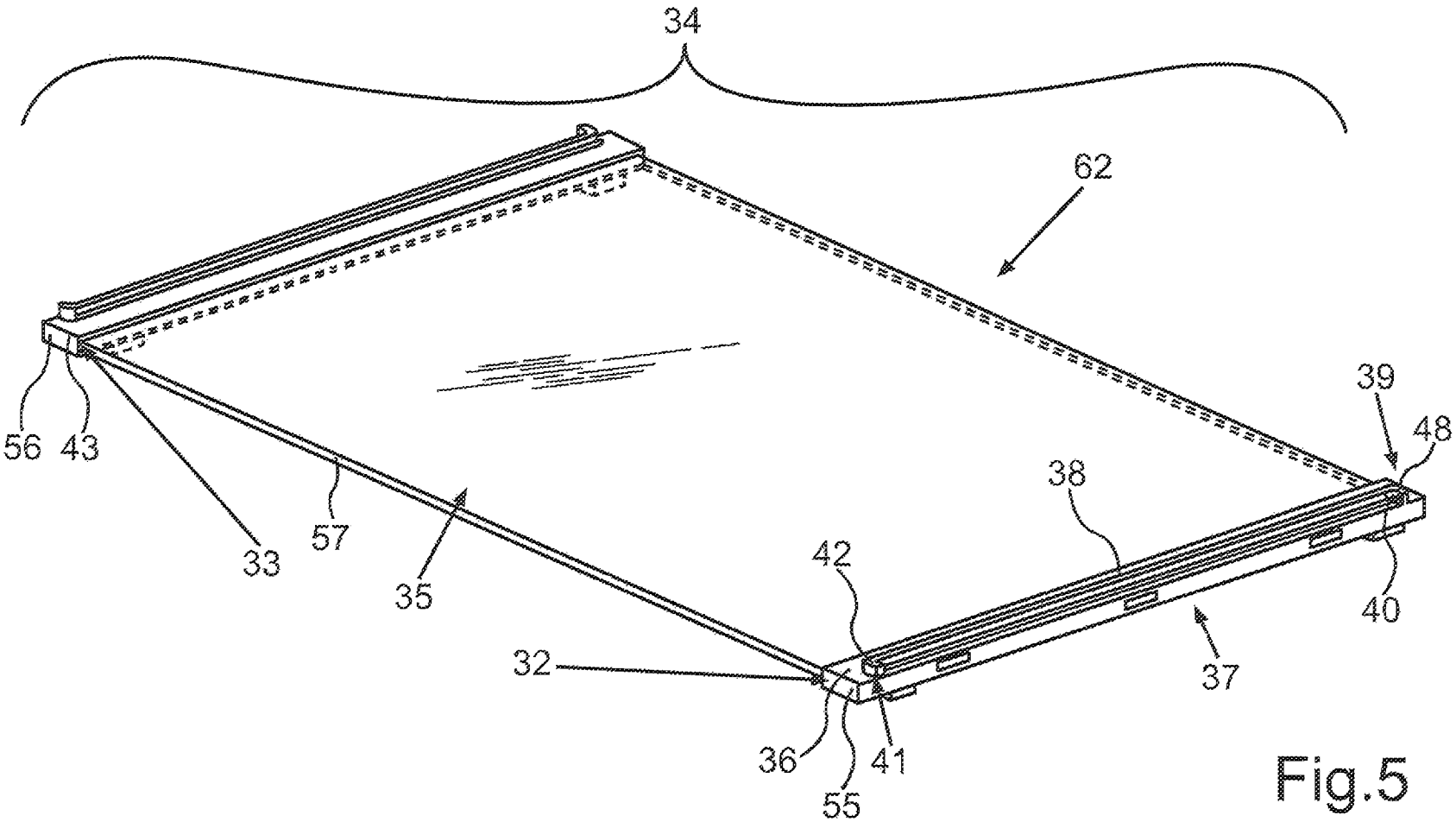
FIG. 5 is a perspective view of an exemplary embodiment of partial components of the pull-out device of FIG. 3.

The support rails 32 and 33 are components of a support tray or tray 34, shown in a perspective view in FIG. 5, which is preferably present in the exemplary embodiment. The tray 34 includes, aside from the support rails 32 and 33, a support panel 35 which, in particular, is a glass panel, but can also be a plastics or metal panel. The support rails 32 and 33 extend in the depth direction over the whole extent of the support panel 35 and are thus preferably also edge-side borders of the support panel 35. By the support panel 35 and the support rails 32 and 33, a base panel 62, in particular of a mounting cage 61 (FIG. 6) is formed, on which the drawer 10 is placeable. The support rails 32 and 33 grasp the support panel 35 on opposing edge sides so that they also represent a shock-proofing. The support rails 32 and 33 also form the mechanical coupling elements to the holding elements 12 and 15.

By the base panel 62 which has the support panel 35 and the support rails 32 and 33 and the holding elements 12 and 15, a receiving cage and/or the mounting cage 61 for the drawer 10 is formed. The mounting cage 61 is suspended on the pull-out rails 11 which are separate therefrom.

As can be seen from FIG. 5, provided on an upper side 36 of the support rail 32 facing toward the drawer 10, is a slotted guide 37 for guiding the drawer 10. The slotted guide 37 is configured open in the height direction and thus upwardly in the y-direction. It is also configured open in the width direction and thus in the x-direction toward the side and thus toward the adjacent vertical side wall of the inner container 5. The slotted guide 37 has a boundary wall and/or slotted guide wall 38 which projects upwardly from the upper side 36 and is configured extending straight in the depth direction. Formed at a rear end 39 in the depth direction is a coupling pocket 40 which is open forwardly but is closed upwardly in the height direction. The coupling pocket 40 is preferably integrated into the slotted guide 37 which means, in particular, that the walls delimiting the coupling pocket 40, specifically a rear wall 51 (FIG. 8) and a roof wall 48, open in one piece into the slotted guide wall 38. In the exemplary embodiment shown, the coupling pocket 40 then also represents the rear end 39 of the slotted guide 37.

Provided at a front end 41 of the slotted guide 37 is a pull-out stop element 42 which is, in particular, a stop web oriented in the width direction. In the exemplary embodiment, the pull-out stop element 42 delimits the slotted guide 37 forwardly and also opens integrally into the slotted guide wall 38.

Accordingly, at the further support rail 33 on an upper side 43 facing the drawer 10, a corresponding embodiment with a slotted guide and a corresponding coupling pocket and a corresponding pull-out stop element is realized, as formed at the support rail 32 and has been described in relation thereto.

It is thus preferably provided that a coupling pocket 40, a slotted guide 37 and a pull-out stop element 42 is provided, in particular integrated, in a support rail 32, 33.

Figure 6:
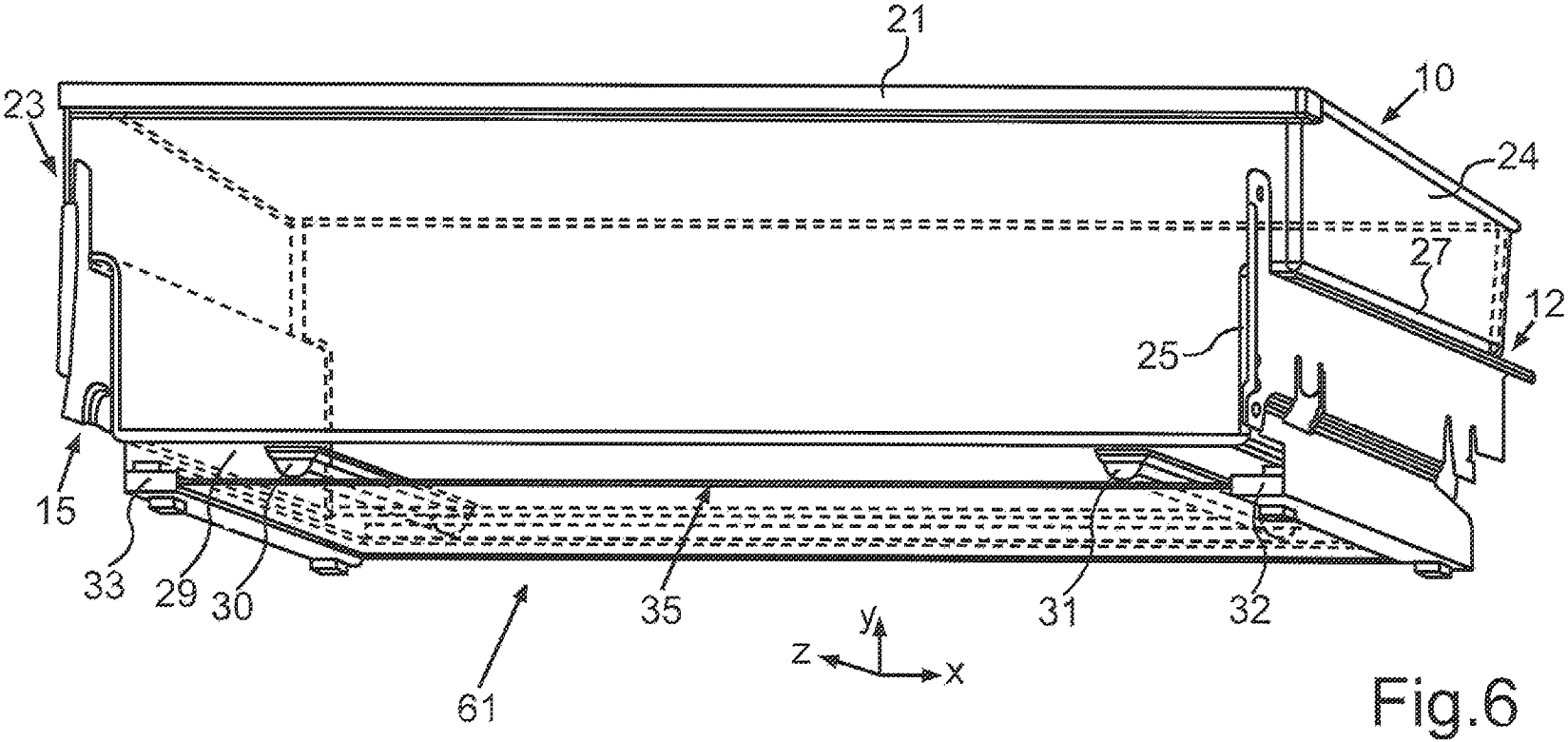
FIG. 6 is a perspective view of partial components of the pull-out device of FIG. 3 with a container placed thereon.

In FIG. 6, the assembled state of the components according to FIGS. 4 and 5 is shown. It is herein apparent that the positioning skids 30 and 31 are seated directly on an upper side of the support panel 35.

Figure 7:
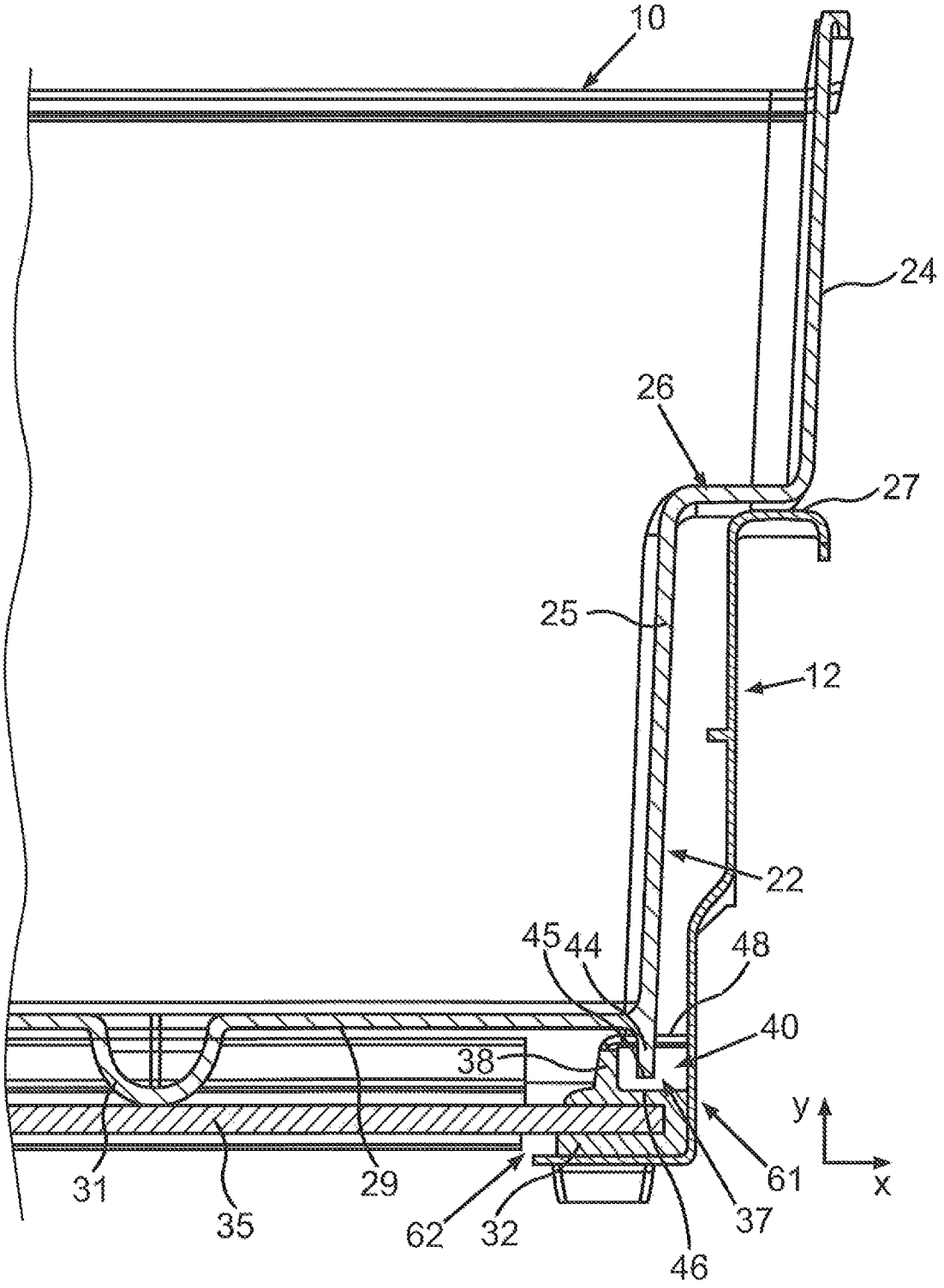
FIG. 7 is a sectional view of the representation in FIG. 6 in a subregion of the representation of FIG. 6.

FIG. 7 shows the representation of FIG. 6 in a vertical sectional representation in the x-y plane wherein in FIG. 7, only a partial portion of FIG. 6 is shown. As shown here, a lateral edge of the support panel 35 is grasped by the support rail 32 so that thereby a certain amount of edge protection is also formed.

It is evident that a stop 44 which extends downwardly at the underside 29 is formed integrally at the underside 29, in particular at a transition between the underside 29 and the side wall 22. The stop 44 is configured, in particular, as an elongate skid and preferably extends straight in the depth direction. It extends into the slotted guide 37 from above, as shown in FIG. 7. In the embodiment shown here, an essential point to be seen therein is that a lower edge 45 of this stop 44 is arranged, in the height direction and thus the y-direction, spaced from the pull-out device and/or the pull-out carriage 7 and, in particular, from the support rail 32, and in particular, from an upper side 46 of a floor delimiting the slotted guide 37. This contactless positioning enables a particularly freely moving coupling of a coupling element 50 (FIG. 8) formed integrally on the stop 45 with the coupling pocket 40. As also shown in FIG. 7, the stop 44 is arranged spaced, seen in the width direction, from the slotted guide wall 38 and is also spaced from the holding element 12.

Also shown in FIG. 7 is the roof wall 48 of the coupling pocket 40.

Figure 8:
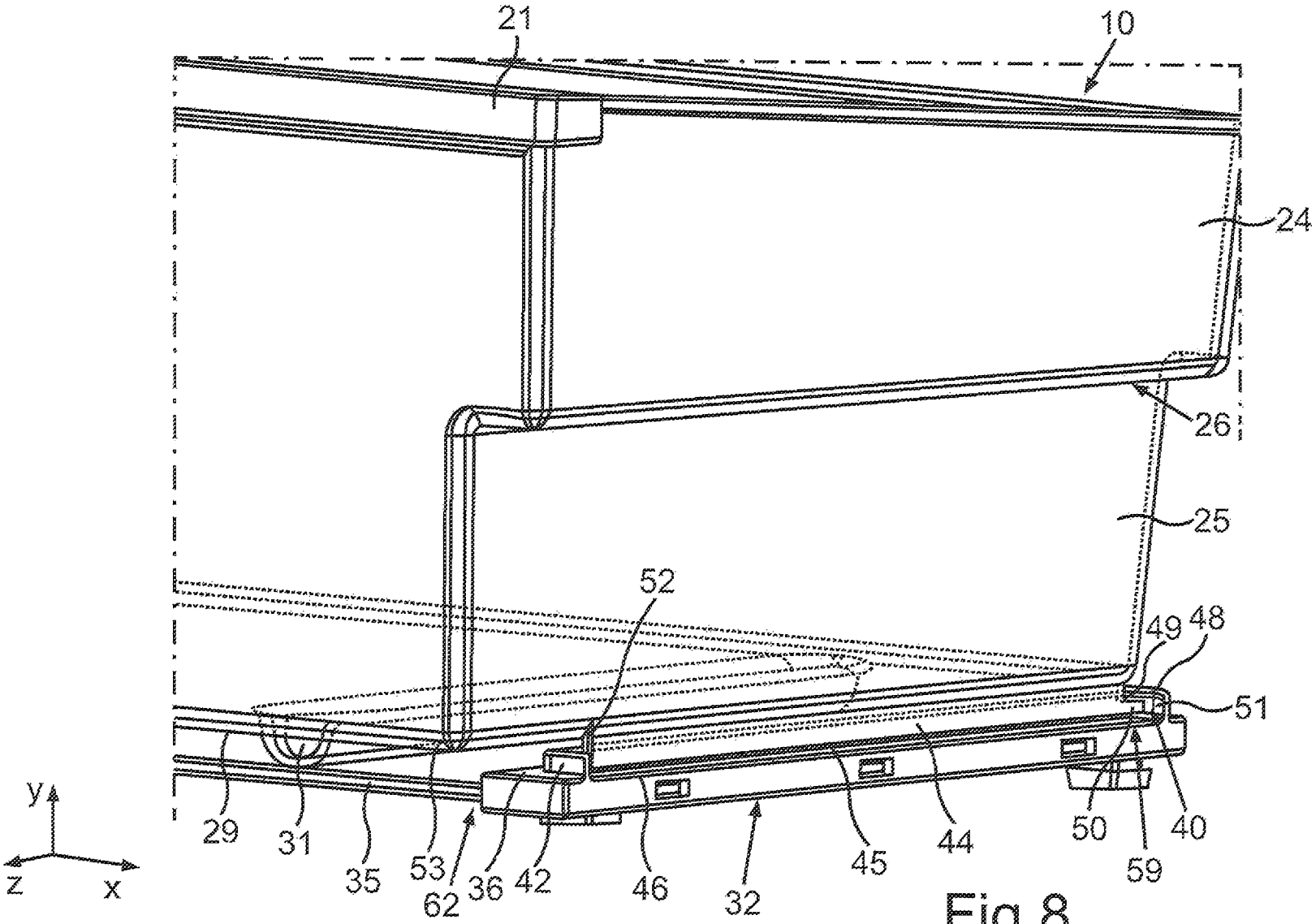
FIG. 8 is a perspective partial view of the components according to FIG. 5 with a container placed thereon.

FIG. 8 shows a perspective view of the embodiments of FIGS. 6 and 7, but without the holding element 12, to allow a better view of the stop 44, the coupling pocket 40 and the pull-out stop element 42.

As shown by FIG. 8, the stop 44 extends as far as the rear end of the drawer 10. At a rear edge 49 of the stop 44, the coupling element 50 is formed on integrally, as mentioned above. The coupling element 50 is, in particular, a coupling pin arranged rearwardly in the depth direction which, in the mounted position shown in FIG. 8 of the drawer 10 on the pull-out device and thus on the support rails 32 and 33, is immersed in the coupling pocket 14 and extends thereinto so that, seen in the depth direction, the coupling element 50 overlaps with the roof wall 48. The coupling pocket 40 is delimited, as is more precisely visible in FIG. 8, by the rear wall 51 onto which the roof wall 48 leads.

It is further apparent that a front end 52 of the stop 44 is offset rearwardly in relation to a front end 53 of the drawer 10 and thus, in particular, also to the underside 29.

Furthermore, the stop 44 is configured, seen in the height direction, with a dimension such that an overlap with the height of the pull-out stop element 42 is achieved in the mounted position, in order in this regard also to achieve an effective pull-out stop.

Figure 9:
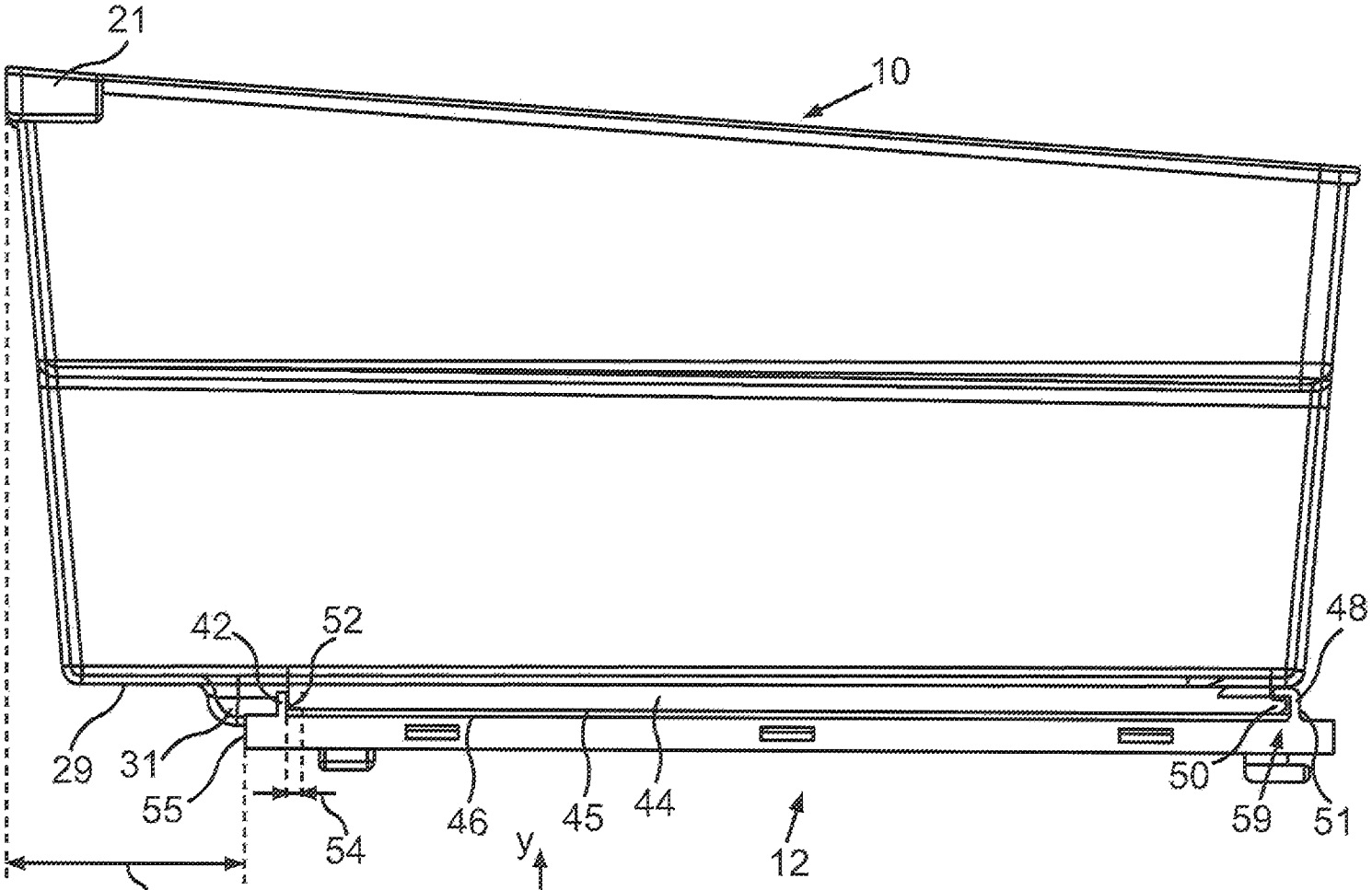
FIG. 9 is a side view of the representation according to FIG. 8 with a rawer arranged on the pull-out device in the mounted position.

FIG. 9 shows a side view of the representation in FIG. 8. It is apparent here that, in its mounted position, the drawer 10 is arranged, in the depth direction, on the support rails 32 and 33 with play 54. The play 54 therefore enables a relative movement capability between the drawer 10 and the pull-out device, in particular, in the support rails 32 and 33 in this achieved mounted position of the drawer 10.

It is, in particular, very advantageous if the coupling element 50 and the coupling pocket 40 are configured such that an immersion of the coupling element 50 into the coupling pocket 40 is achieved over the entire movement path of the drawer 10 on the support rail 32 and the support rail 33. This means that over the entire play 54, the coupled state between the coupling element 50 and the coupling pocket 40 is maintained. This is particularly advantageous since thereby a simple removal of the drawer 10 from the support rails 32 and 33 as well as a simple mounting on the support rails 32 and 33 is enabled, although with this relative movement capability, an undesirable tilting of the drawer 10 about an axis oriented in the width direction is also prevented. It is then particularly advantageous if, as is made clear in FIGS. 9 and 10, the drawer 10 extends, as seen in the depth direction, beyond a front-side end 55 (FIG. 5) of the support rail 32 and a front-side end 56 (FIG. 5) of the support rail 33 and beyond a front-side edge 57 (FIG. 5) of the support panel 35, so that a spacing 47 in the depth direction results between a maximum front position of the drawer 10 and the edge 57. By this means, a gap 60 (FIG. 2) from the inner side 13 is formed and the unhindered flow of the air stream 20 is achieved.

Figure 10:
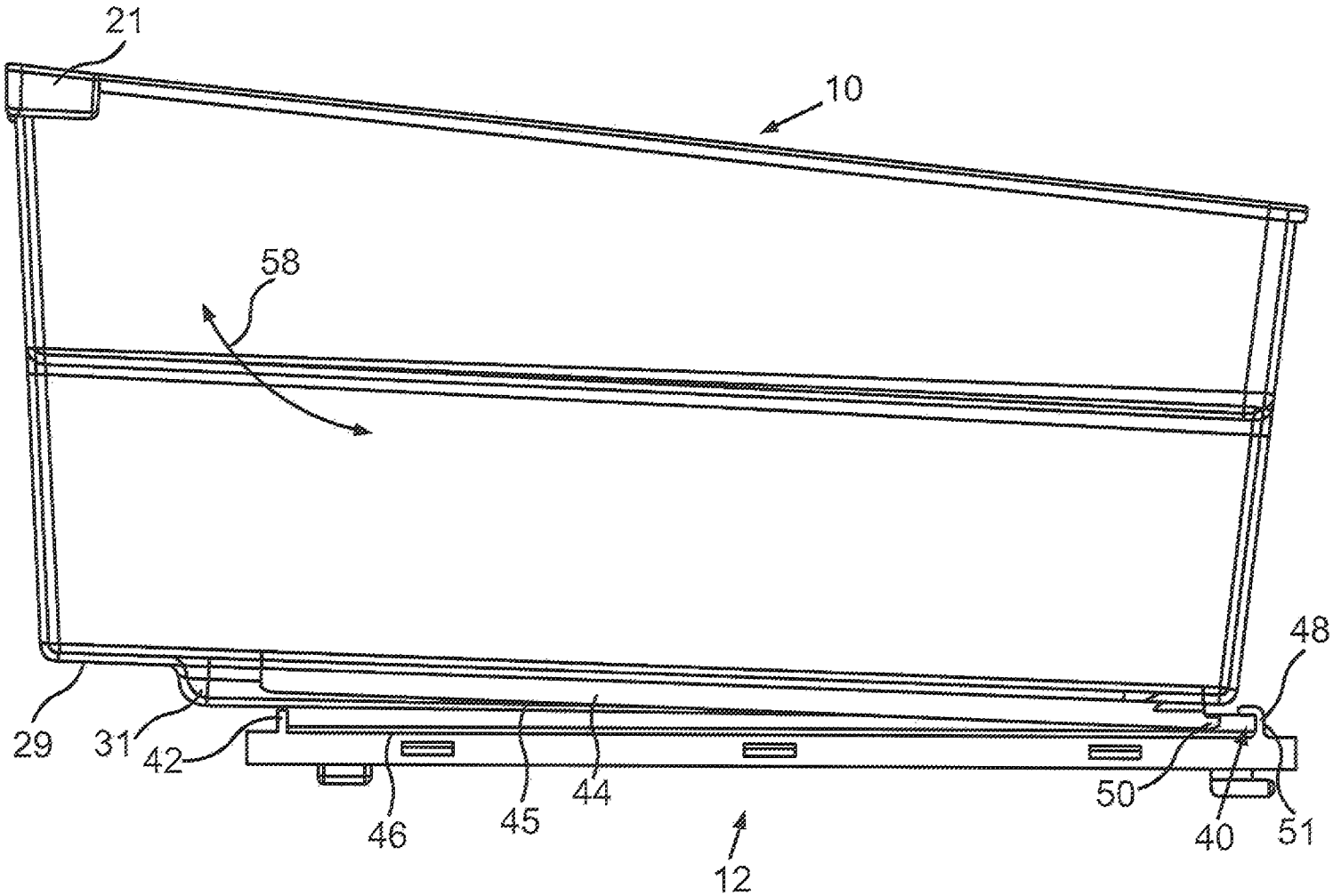
FIG. 10 is a side view according to FIG. 9 with the drawer partially removed from the pull-out device and therefore removed from a mounted position by an at least partial upward pivot movement.

FIG. 10 shows, for further elucidation, a position of the drawer 10 removed from the mounted position. By means of the play 54, it is more easily possible in this context to lift the drawer 10 with an upward pivot movement 58 (as indicated) from the support rails 32 and 33 and then to release the coupled state of the tilt prevention device 59 which is formed by the coupling element 50 and the coupling pocket 40 and to release the tilt protection state. The holding element 12 and the support web 63 are configured accordingly.

Figure 11:
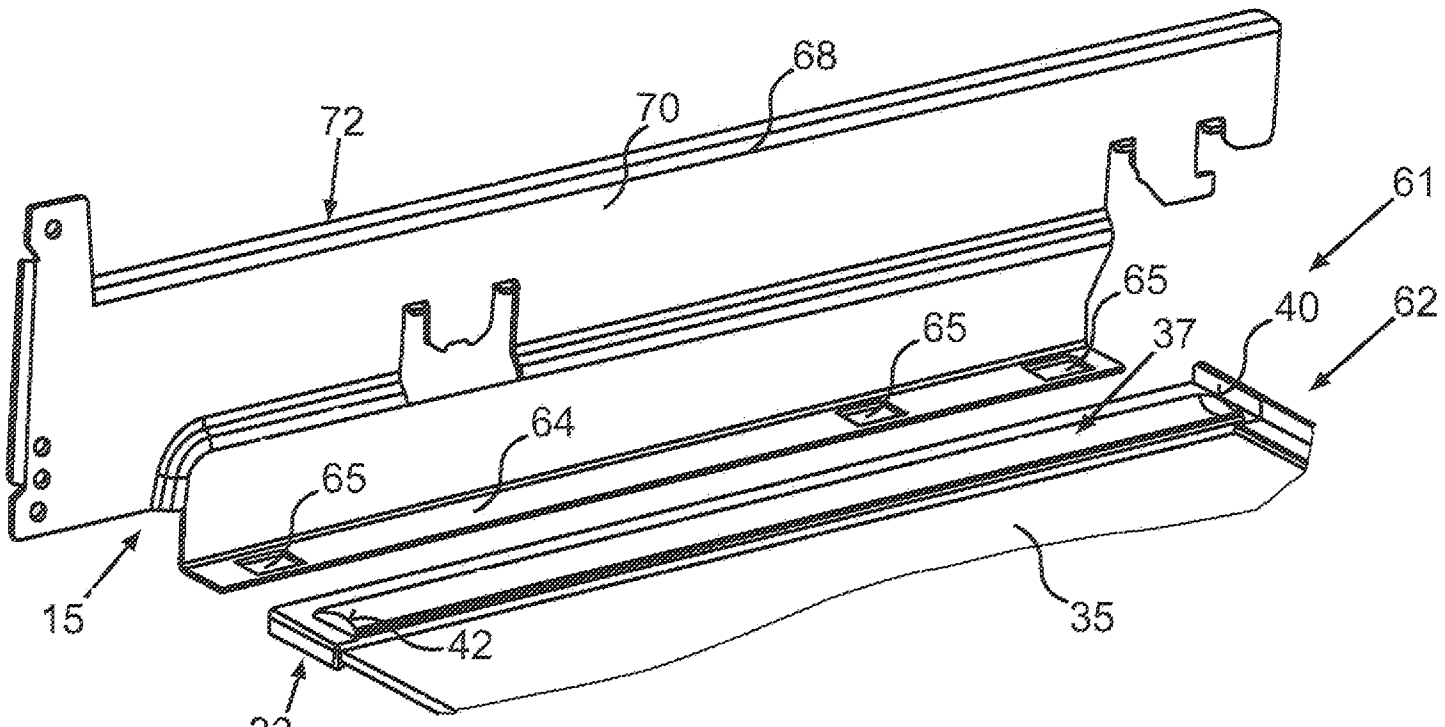
FIG. 11 is a perspective view of disassembled subcomponents of a mounting cage of the pull-out device.

FIG. 11 shows a perspective view of the mounting cage 61 in an exemplary embodiment with subcomponents that are shown disassembled. The base panel 62 is herein separated from the holding element 15, wherein the connection between the base panel 62 and the holding element 15 is non-destructively releasable. The holding element 15 is shown with its panel-shaped basic part 70. On the lower edge situated opposing the upper edge 68, a horizontally inwardly positioned support web 64 is inwardly bent, on which in the assembled state, the support rail 33 is seated. As can be seen, in this support web 64 in the exemplary embodiment, not only one receptacle 65, but a plurality of such receptacles 65 is provided which here are configured as through holes, in particular, with a polygonal hole contour. In the assembled state, coupling elements 66 (FIG. 13), which are formed on an underside 67 of the support rail 33, in particular, integrally, engage in these receptacles 65. Configured between these coupling elements 66 and the receptacles 65 is a plug-in connection which is non-destructively releasable. In particular, the coupling elements 66 are adapted in their external geometry to the geometry of the receptacle 65, so that, in particular, an exactly fitting use and thus an exactly fitting insertion of the coupling elements 66 in the receptacles 65 is enabled. The holding element 12 and the support web 63 are configured accordingly.

Figure 12:
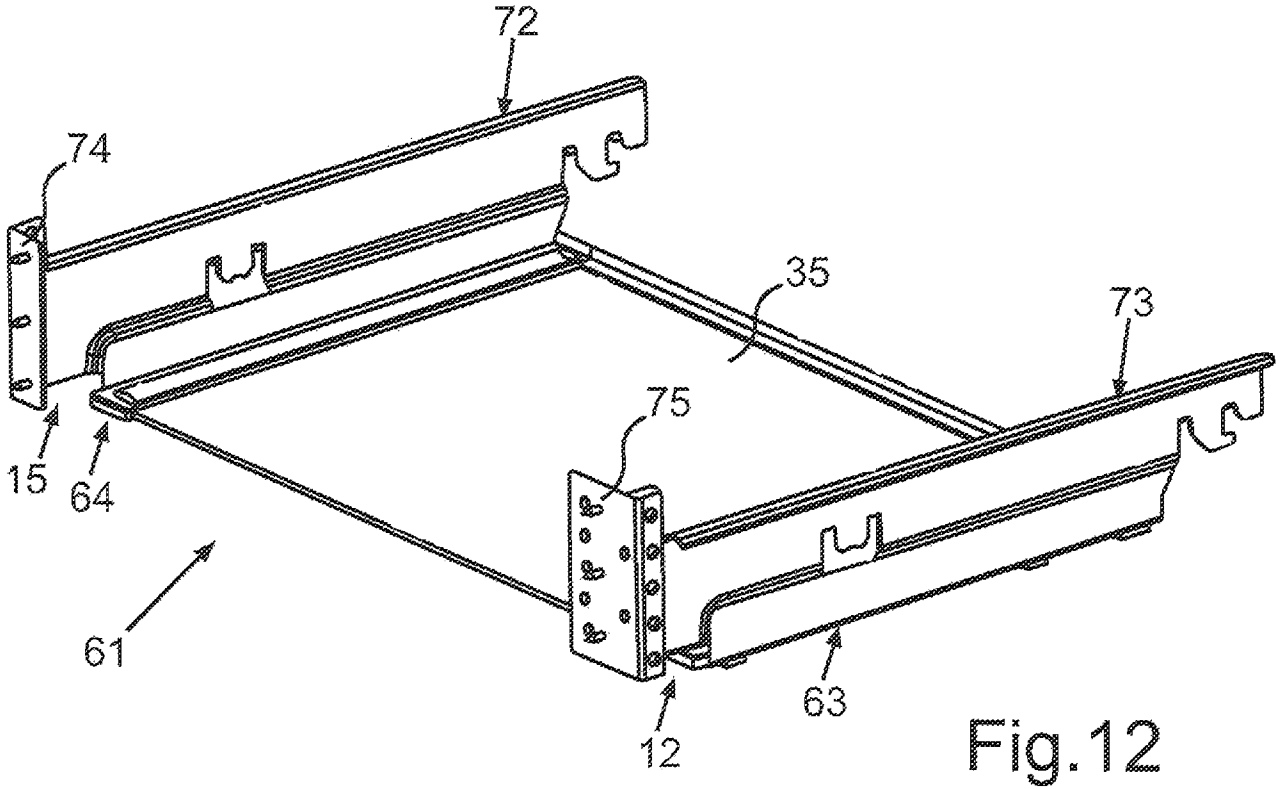
FIG. 12 is a perspective view of the mounting cage according to FIG. 11 in an assembled state.

As shown, according to the assembled representation of the mounting cage 61 in FIG. 12, the holding elements 12 and 15 are arranged on opposite sides of the base panel 62, as seen in the width direction and thus in the x-direction. Due to their panel-shaped configuration, in particular of the basic parts 70 and 71, the holding elements 12 and 15 are thus configured as lateral cage walls and thus as lateral borders of the mounting cage 61. The holding elements 12 and 15 are configured as suspension elements for non-destructively releasable suspension of the mounting cage 61 on pull-out rails 11 of the pull-out device that are separate from the mounting cage 61. For this, in particular, the suspension webs 72 and 73 are provided which in a vertical sectional representation and thus in an x-y plane, are configured channel-shaped and thus form a downwardly open channel. This can be configured, for example, as an inverted U-shape. In this context, the guide elements 27 and 28 are then specifically configured as these suspension webs 72 and 73 with their specific geometry.

Figure 13:
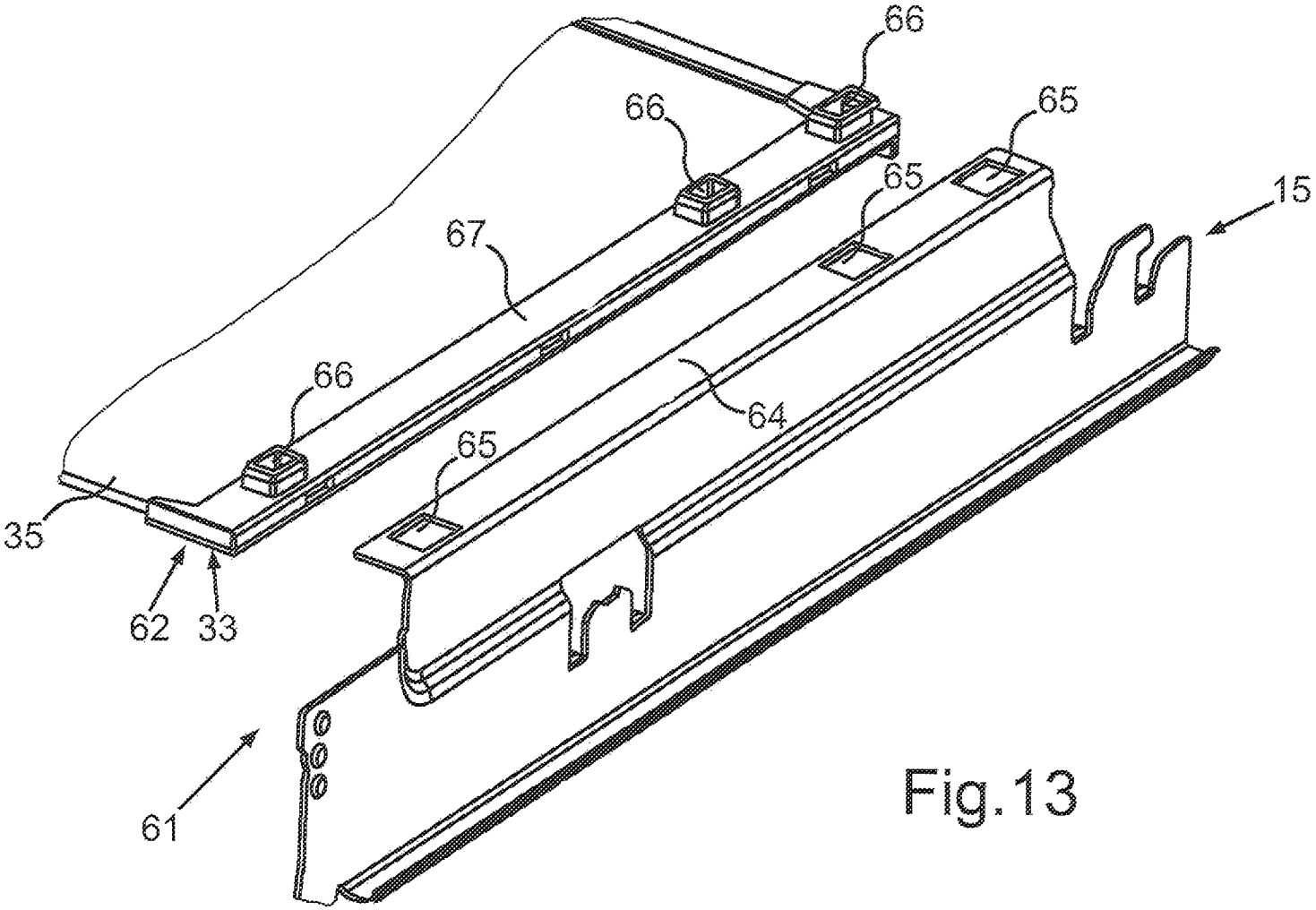
FIG. 13 is a perspective view of the subcomponents according to FIG. 11 in a view from beneath.

As shown, in particular, in FIGS. 11 to 13, the mounting cage 61 is configured open, seen in the depth direction and thus rearwardly, which means that is has no rear wall. The mounting cage 61 is delimited at the front side by the door 9 which can thus also be considered the front wall of the pull-out carriage 7. In FIG. 12, the door 9 is not shown, although it is fastened, in particular screw-fastened, onto additional front flanges 74 and 75. These front flanges 74 and 75 can be separate parts, although they can also be integrated into the holding elements 12 and 15.

With regard to the suspension of the holding elements 12 and 15 on the pull-out rails 11, in particular on their running rails, it can also be provided that corresponding engagement elements couple with receptacles so that an interlocking or meshing takes place in the height direction between a holding element 12, 15 and a pull-out rail 11, so that the movement coupling between these components takes place on pushing back and forth in the depth direction.

Figure 14:
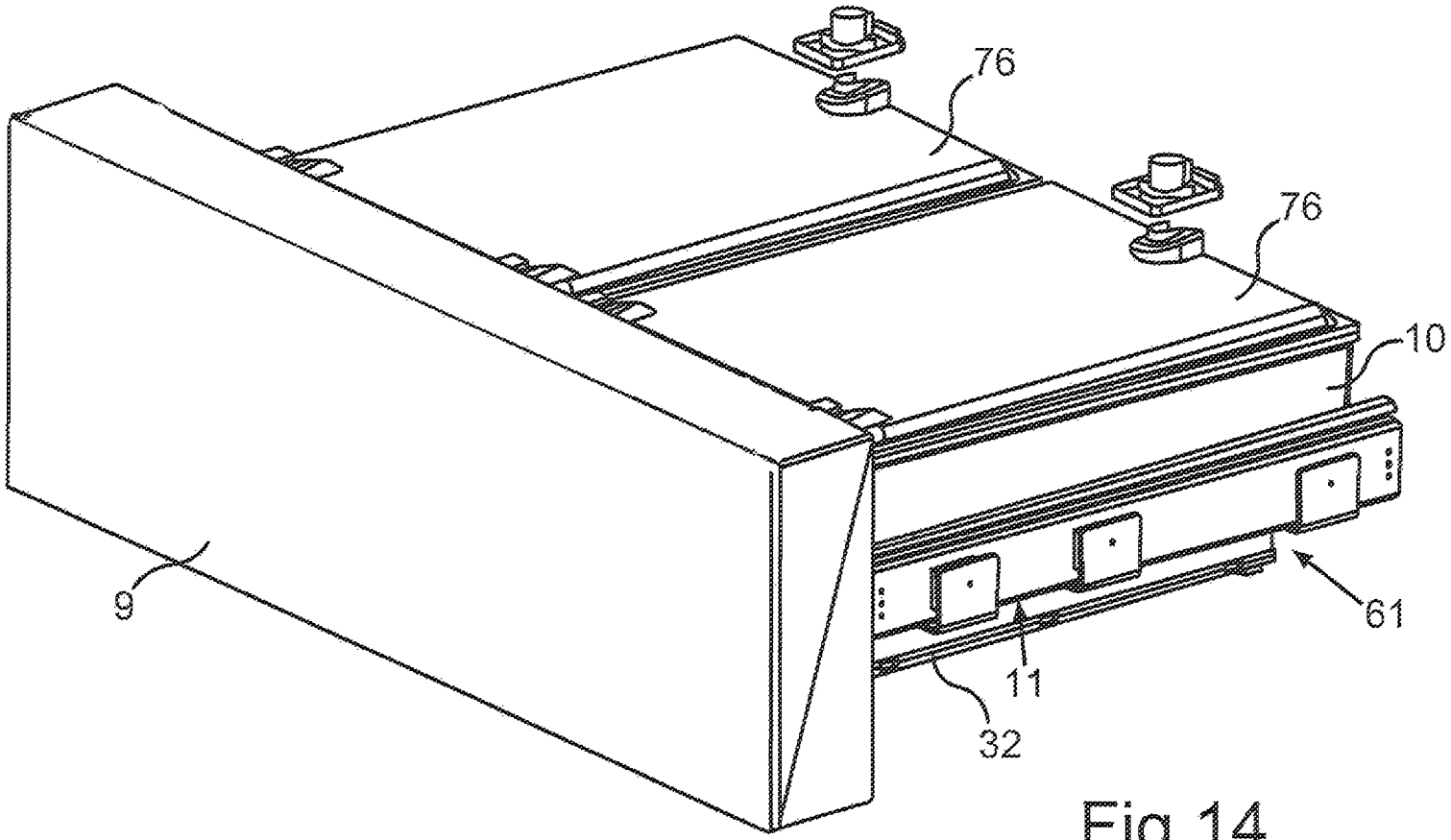
FIG. 14 is a perspective view of a further exemplary embodiment in which the container is configured as a keep-fresh container.
Figure 15:
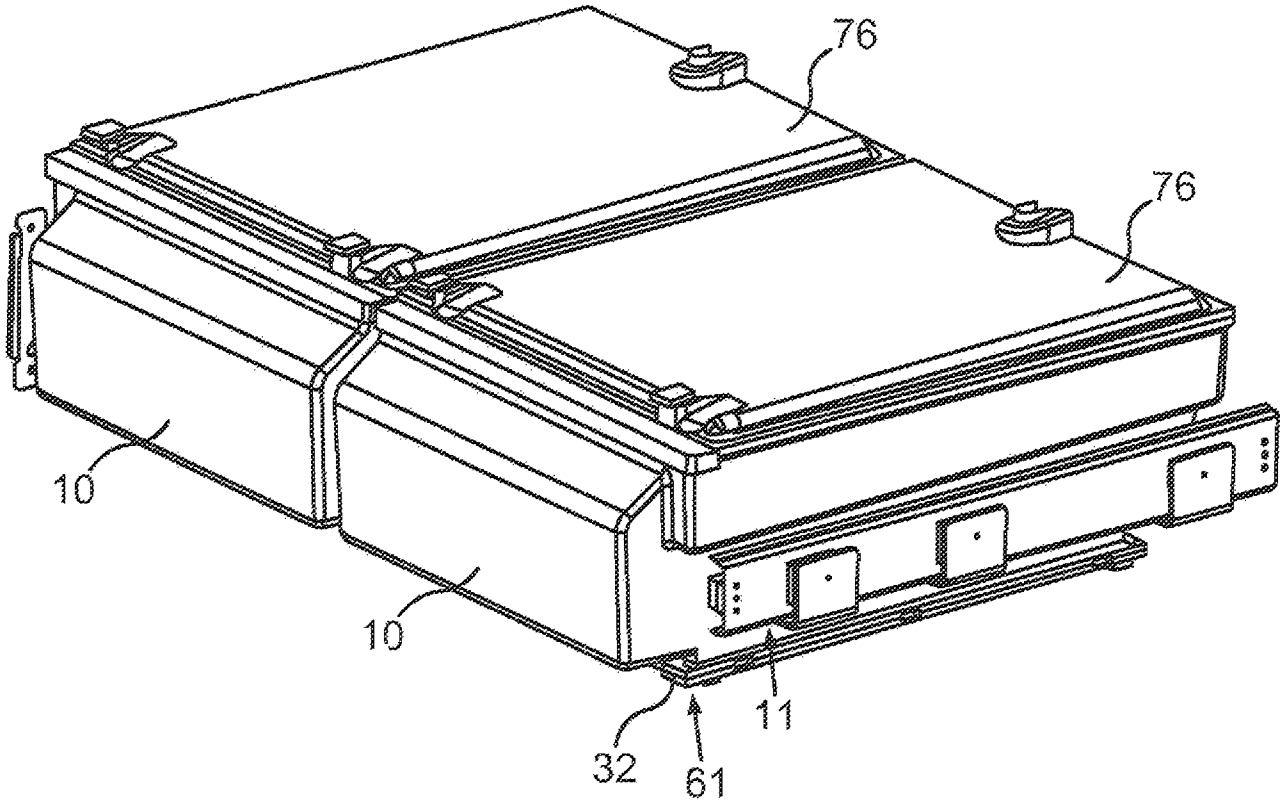
FIG. 15 is a perspective view according to FIG. 14 in which a door of the pull-out carriage is removed.

In FIG. 14, a further exemplary embodiment is shown in a perspective view, in which two separate drawers 10 are arranged on the mounting cage 61. The containers herein also each have a cover 76 in addition to the drawers 10. The containers are herein keep-fresh containers in which by means of a humidifying device (not shown) of the domestic refrigeration appliance 1, an individual ambient humidity different from the remaining volume of the receptacle chamber 6 is settable. For this, the humidifying device contains, in particular, an atomizer unit, for example, a piezo-atomizer with which liquid, in particular water from a tank of the humidifying device is atomized and is then introduced by means of a blower as a fluid mist into the keep-fresh container. Each cover 76 is raisable and lowerable by means of an actuating mechanism. FIG. 15 shows the embodiment of FIG. 14 without the door 9.

In FIGS. 14 and 15, also shown purely by way of example in their positional arrangement and number, are three panel-shaped connecting flanges provided in the region of the pull-out rail 11, which are provided for fastening the pull-out rail 11 to a vertical side wall of the inner container.

The following is a summary list of reference numerals and the corresponding structure used in the above description of the invention:

1 Domestic refrigeration appliance
2 Housing
3 Door
4 Door
5 Inner container
6 Second receptacle chamber
7 First pull-out carriage
8 Second pull-out carriage
9 Door
10 Drawer
11 Pull-out rail
12 Holding element
13 Inner side
14 Drawer
15 Holding element
16 Module
17 Evaporator
18 Blower
19 Housing
20 Air stream
21 Front strip
22 Side wall
23 Side wall
24 Wall portion
25 Wall portion
26 Step
27 Guide element
28 Guide element
29 Underside
30 Positioning skid
31 Positioning skid
32 Support rail
33 Support rail
34 Tray
35 Support panel
36 Upper side
37 Slotted guide
38 Boundary wall
39 Rear end
40 Coupling pocket
41 Front end
42 Pull-out stop element
43 Upper side
44 Stop
45 Stop
46 Upper side
47 Spacing
48 Roof wall
49 Rear edge
50 Coupling element
51 Rear wall
52 Front end
53 Front end
54 Play
55 Front-side end
56 Front-side end
57 Front-side edge
58 Pivot movement
59 Tilt prevention device
60 Gap
61 Mounting cage
62 Base panel
63 Support web
64 Support web
65 Receptacle
66 Coupling element
67 Underside
68 Edge
69 Edge
70 Basic part
71 Basic part
72 Suspension web
73 Suspension web
74 Front flange
75 Front flange
76 Cover

The invention claimed is:

1. A domestic refrigeration appliance, comprising:

an inner container having walls;

a receptacle chamber for food delimited by said walls of said inner container;

a pull-out device disposed on said inner container and able to be pushed into and withdrawn in a pull-out direction from said receptacle chamber relative to said inner container, said pull-out device having a coupling pocket; and a container for receiving the food, said container being removably positionable on said pull-out device, said container having a rear region with a coupling element being a coupling pin projecting opposite the pull-out direction and engaging in said coupling pocket, so that a tilt prevention device is provided for said container, wherein a mounted position of said container in which said container is placed on said pull-out device, is configured with a relative movement capability in relation to said pull-out device, having play defined as seen in a depth direction of the domestic refrigeration appliance, and said tilt prevention device configured for having said coupling pin extending into said coupling pocket over an entirety of the play.

2. The domestic refrigeration appliance according to claim 1, wherein said pull-out device has a pull-out stop element opposite said coupling pin in the pull-out direction by which said container is delimited forwardly in the relative movement capability, wherein by means of said pull-out stop element, the play is delimited forwardly in the depth direction.

3. The domestic refrigeration appliance according to claim 2, further comprising a stop disposed on said container, said stop is configured, on a movement of said container relative to said pull-out device, seen in the depth direction of the domestic refrigeration appliance, to contact said pull-out stop element.

4. The domestic refrigeration appliance according to claim 3, wherein said stop is configured as a skid on a transition between an underside and a side wall of said container.

5. The domestic refrigeration appliance according to claim 3, wherein said coupling element is configured integrated into said stop.

6. The domestic refrigeration appliance according to claim 3, wherein, seen in a height direction of the domestic refrigeration appliance, in the mounted position of said container on said pull-out device, said stop is disposed with a lower edge spaced from said pull-out device.

7. The domestic refrigeration appliance according to claim 2, further comprising a stop disposed on said container; and wherein said pull-out device has a slotted guide configured open upwardly and, also toward a vertical wall of said inner container and in said slotted guide, in the mounted position of said container on said pull-out device, said stop disposed on said container engages from above and is guided.

8. The domestic refrigeration appliance according to claim 7, wherein said coupling pocket is integrated into said slotted guide.

9. The domestic refrigeration appliance according to claim 7, wherein said pull-out stop element is integrated into said slotted guide.

10. The domestic refrigeration appliance according to claim 7, wherein said coupling pocket is integrated into a rear end of said slotted guide.

11. The domestic refrigeration appliance according to claim 7, wherein said pull-out stop element is integrated into a front end of said slotted guide.

12. The domestic refrigeration appliance according to claim 1, wherein said pull-out device has at least one support rail, on which said coupling pocket is disposed.

13. The domestic refrigeration appliance according to claim 12, wherein said pull-out device has a support panel, on said support panel said container is placed in the mounted position.

14. The domestic refrigeration appliance according to claim 13, wherein said container, in the mounted position on said pull-out device, seen in the depth direction of the domestic refrigeration appliance, is disposed protruding forwardly in relation to said support rail and/or in relation to said support panel.

15. The domestic refrigeration appliance according to claim 13, further comprising rail-shaped holding elements; and said pull-out device is configured as a pull-out carriage having a door on which on an inner side of said door facing toward said receptacle chamber said rail-shaped holding elements protruding rearwardly are disposed, and on said rail-shaped holding elements said container is mounted.

16. The domestic refrigeration appliance according to claim 15, wherein between said inner side of said door and a front end of said support rail facing toward said inner side and/or a front edge of said support panel, a gap is formed.

17. The domestic refrigeration appliance according to claim 1, wherein said pull-out device has at least one support rail with a slotted guide for said container, said support rail further having said coupling pocket integrated therein.

18. The domestic refrigeration appliance according to claim 1, wherein:

said container has at least one positioning skid formed on an underside of said container; and said pull-out device has a support panel formed from glass, and on said support panel said container is placed in the mounted position.

19. The domestic refrigeration appliance according to claim 1, further comprising rail-shaped holding elements;

further comprising a tray having support rails and a support panel, said container is disposed with play on said tray; and wherein said pull-out device is configured as a pull-out carriage having a door on which on an inner side of said door facing toward said receptacle chamber said rail-shaped holding elements protruding rearwardly are disposed, and on said rail-shaped holding elements, said container on said tray is mounted.

20. The domestic refrigeration appliance according to claim 1, wherein said pocket has a roof wall, said coupling pin overlaps said roof wall of the entirety of the play.

21. A domestic refrigeration appliance, comprising:

an inner container having walls;

a receptacle chamber for food delimited by said walls of said inner container;

a pull-out device disposed on said inner container and able to be pushed into and withdrawn from said receptacle chamber relative to said inner container, said pull-out device having a coupling pocket; and a container for receiving the food, said container being removably positionable on said pull-out device, said container having a rear region with a coupling element engaging in said coupling pocket, so that a tilt prevention device is provided for said container, said container having, at least at one vertical side wall, a step so that an upper wall portion of said vertical side wall, as seen in a height direction of the domestic refrigeration appliance, is offset outwardly, as seen in a width direction of the domestic refrigeration appliance relative to a lower wall portion of said vertical side wall, wherein a mounted position of said container in which said container is placed on said pull-out device, is configured with a relative movement capability in relation to said pull-out device, having play defined as seen in a depth direction of the domestic refrigeration appliance, and said tilt prevention device is configured such that over an entirety of the play, said coupling element extends into said coupling pocket.

* * * * *